United States Patent [19]

Honegger

[11] Patent Number: 4,844,256

[45] **Date of Patent: * Jul. 4, 1989**

[54] METHOD OF PREPARING A SHIPMENT PACKAGE OF PRINTED PRODUCTS ARRIVING IN AN IMBRICATED FORMATION AND PACKAGE OBTAINED THEREBY

[75] Inventor: Werner Honegger, Tann-Rüti, Switzerland

[73] Assignee: Ferag AG, Hinwil, Switzerland

[ * ] Notice: The portion of the term of this patent subsequent to Aug. 25, 2004 has been disclaimed.

[21] Appl. No.: 59,851

[22] Filed: Jun. 8, 1987

Related U.S. Application Data

[63] Continuation-in-part of Ser. No. 818,356, Jan. 13, 1986, Pat. No. 4,688,368, which is a continuation of Ser. No. 525,679, Aug. 23, 1983, abandoned.

[30] Foreign Application Priority Data

Sep. 2, 1982 [CH] Switzerland ..... 5212/82

[51] Int. Cl.[4] ..... B65B 13/02; B65B 63/04

[52] U.S. Cl. ..... 206/390; 53/399; 53/430; 206/409

[58] Field of Search ..... 53/399, 430, 118, 465, 53/211; 242/59; 206/390, 409, 820; 229/175

[56] References Cited

U.S. PATENT DOCUMENTS

| | | | |
|---|---|---|---|
| 789,707 | 5/1905 | Bellamy | 242/59 |
| 1,819,122 | 8/1931 | Resnati | 206/390 X |
| 3,013,367 | 12/1961 | Le Sarre | 53/211 X |
| 3,263,390 | 8/1966 | Dexter | 53/118 X |
| 3,715,861 | 2/1973 | Odelberg | 53/211 |
| 3,927,504 | 12/1975 | Forrister | 53/430 |
| 4,063,693 | 12/1977 | Achelpohl | 53/118 X |
| 4,171,047 | 10/1979 | Doyle | 206/409 X |
| 4,219,129 | 8/1980 | Sedgwick | 206/409 X |

FOREIGN PATENT DOCUMENTS 1047002 1/1979 Canada .

*Primary Examiner*—John Sipos
*Attorney, Agent, or Firm*—Werner W. Kleeman

[57] ABSTRACT

The imbricated product formation is fed to a wind-up location and is wound-up to form a product roll at this location. At the start of the wind-up operation the leading edge or end of the frontmost printed product is rolled back in a direction towards one side or surface of this frontmost printed product. The wind-up of the following printed products in the imbricated product formation is effected in the same product winding direction. At the end of the wind-up operation an elongated holding element or strapping band is laid around the completed product roll which then holds the product roll together and also possibly protects the same. The winding direction is selected in accordance with the predetermined structure of the imbricated product formation and results in a roll-shaped wound product package which, if desired, can be disassembled starting from the center thereof without the holding element or strapping band having to be released.

9 Claims, 2 Drawing Sheets

METHOD OF PREPARING A SHIPMENT PACKAGE OF PRINTED PRODUCTS ARRIVING IN AN IMBRICATED FORMATION AND PACKAGE OBTAINED THEREBY

CROSS-REFERENCE TO RELATED APPLICATIONS

This application is a continuation-in-part of my commonly assigned, copending U.S. patent application Ser No. 06/818,356, filed Jan. 13, 1986 and entitled "METHOD OF PREPARING A SHIPMENT PACKAGE OF PRINTED PRODUCTS ARRIVING IN AN IMBRICATED FORMATION AND PACKAGE OBTAINED THEREBY" now U.S. Pat. No. 4,688,368, granted Aug. 25, 1987, which, in turn, is a continuation of my commonly assigned U.S. patent application Ser. No. 06/525,679, filed on Aug. 23, 1983, and entitled "METHOD OF PREPARING A SHIPMENT PACKAGE OF PRINTED PRODUCTS ARRIVING IN AN IMBRICATED FORMATION AND PACKAGE OBTAINED THEREBY", now abandoned.

BACKGROUND OF THE INVENTION

The present invention relates to a new and improved method of preparing a self-contained ready-for-shipment package of printed products arriving in an imbricated formation. The present invention also relates to a package of printed products produced in accordance with such method.

At times throughout this disclosure reference to such method and package will simply generally be made with reference to printed products. While the description to follow, as a matter of convenience, refers to the processing of printed products, obviously other types of products can be conveniently handled, and therefore, the use of this term is not to be construed in a limiting sense in any way whatsoever, but merely is to be viewed as an exemplary and desirable field of application for the inventive measures.

In a method for forming packages from printed products arriving in an imbricated formation as known, for example, from German Patent Publication No. 2,752,514 and from the corresponding U.S. Pat. No. 4,140,052, the printed products are stacked in a vertical stacking compartment or chute. During formation of the product stack partial stacks or stack sections are placed in a cross-wise configuration upon one another. To obtain a sufficient stability of the stack formed from the superimposed stacked printed products the stack must be compressed during and/or at the end of the stacking operation. Subsequently, there is accomplished an intermediate transport of the stack formed of the printed products which are loosely placed one upon the other to a packing station at which the product package is provided with a protective cover constituted by, for example, a plastic foil by means of a wrapping machine. Then, the thus processed product package is provided with a strapping band. For the strapping operation, which frequently is performed in a cross-wise configuration, there is preferably used a cord or plastic strap or band.

As will be readily recognized from the aforementioned discussion, such a formation of packages ready-for-shipment requires a considerable expenditure with respect to apparatus and time. Additionally, the printed products must be compressed during the stacking operation and also during the strapping operation, as already mentioned. This is undesirable because during such compression there is the danger of smearing the printing ink which has not yet completely dried.

On the side of the receiver of the product package it is necessary to open the product package or package for removal of individual printed products therefrom. This requires releasing of the strapping band and in most cases, also removal of the protective cover. Apart from the work connected therewith the opening of the product package is associated with the disadvantage that the printed products are no longer held together in the product package which thus tends to fall apart. Furthermore, transporting of the opened printed product package to a different location may be quite troublesome or cumbersome unless the product package is restrapped prior thereto.

Other patents of interest are:

German Patent No. 2,207,556, published Aug. 30, 1983;

British Patent No. 1,594,558, published July 30, 1981;

British Patent No. 2,102,771, published Feb. 9, 1983;

British Patent No. 2,121,772, published Jan. 4, 1984;

British Patent No. 2,121,389, published Dec. 21, 1983; and

British Patent No. 2,117,359, published Oct. 12, 1983.

SUMMARY OF THE INVENTION

Therefore, with the foregoing in mind it is a primary object of the present invention to provide a new and improved method of preparing a shipment package of printed products arriving in an imbricated formation in a manner which is not afflicted with the aforementioned drawbacks and limitations heretofore discussed and to product packages produced by means of such method.

Another important object of the present invention is directed to the provision of a new and improved method of preparing a shipment package of printed products arriving in an imbricated formation which permits the packages to be formed in a simple and protective manner.

Still a further significant object of the present invention is directed to a new and improved method of preparing shipment packages of printed products arriving in an imbricated formation, which product package can be conveniently handled and from which individual printed products can be removed without difficulty and with very little effort.

Now in order to implement these and still further objects of the invention, which will become more readily apparent as the description proceeds, the method of the present development is manifested by the features that there is wound-up the imbricated formation from a first leading end thereof to form a product roll, the winding-up operation being started by rolling-up an exposed edge of the printed product located at the first leading end of the imbricated product formation in a direction towards one side of the printed product, continuing the winding-up operation in the same direction and thereby forming the product roll of printed products by winding-up the imbricated product formation, bringing together with an end section of the imbricated product formation at a second, trailing end thereof an elongated holding element so as to extend beyond the end section, and winding-up the holding element conjointly with the imbricated product formation, thereby wrapping the holding element substantially one complete revolution around the product roll to hold the same together.

Contrary to the initially described prior art method in which the arriving imbricated product formation or imbricated formation first had to be destroyed in order to form a stack, the imbricated formation can be preserved during the wind-up operation. Consequently, the printed products do not have to be released or removed from the imbricated formation prior to the package formation. The package formation thus can be effected in a more simple and in a more product-protective manner as compared to the heretofore known conventional methods.

It is advantageous to place a cover or strapping band element or holding element around the product roll formed from the printed products in order to hold the same together. Advantageously, this is effected in such a way that the cover or strapping band element or holding element is assembled with the imbricated formation, so as to protrude over an end section thereof and is wound-up conjointly therewith. Preferably, the end section or region of the cover or strapping band element or holding element which protrudes past the end section or portion of the imbricated formation when the cover or strapping band element or holding element is completely wound-up, is connected with another section of the cover or strapping band element or holding element, preferably with the other end section thereof. Thus, the covering or strapping of the roll-shaped product package can be effected during the course of the wind-up operation of the printed products. A separate wrapping or strapping operation thus is not required. The cover or holding element can be designed such as to additionally serve for the protection of the printed products in addition to holding the product roll together.

As alluded to above, the invention is not only concerned with the aforementioned method aspects, but also relates to a novel structure of the product package obtained by such method. Generally speaking, the inventive product package comprises printed products and is obtained by winding-up an imbricated formation of products.

To achieve the aforementioned measures and objects of the invention the inventive product package of printed products, in its more specific aspects, comprises printed products wound-up to form a product roll; and the printed products may be individually removable from the product roll at the center thereof.

The product package obtained in this way by winding-up the imbricated formation is easily handled. Due to the particular manner of wind-up or winding of the imbricated formation, the product package can be disassembled without any great effort, for instance, from the inside of the product roll without the wound product package having to be opened. The printed products are thus not damaged and no other printed products can be withdrawn conjointly therewith from the product roll. Since the cover or strapping band element or holding element is preserved up to the last specimen or copy of the printed product, the printed products are also still held together after removal of some of the printed products from the product package.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
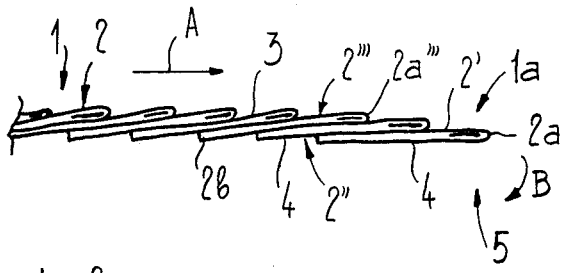
FIGS. 1 to 4 illustrate in a schematic side view the different timewise consecutive phases of the method according to the invention by which an imbricated product formation is wound-up to form a product roll.

Turning attention now specifically to FIGS. 1 to 4 of the drawings, there will be explained in conjunction therewith the formation of a ready-for-shipment package of printed products 2 arriving in an imbricated product formation 1 during different phases of the product package forming process.

The depicted imbricated product formation 1 may constitute part of a longer or more extensive imbricated formation as, for example, outputted by a rotary printing press. This imbricated product formation or imbricated formation 1 is appropriately moved in the direction of the arrow A in a manner not here shown in any particular detail, for example, by means of any suitable band conveyor or the like. Within the imbricated formation 1 the printed products 2 are superimposed in the manner of tiles on a roof, each printed product 2 resting with its bottom side or surface 4 upon a top side or surface 3 of the immediately preceding or leading printed product 2. Thus, a leading edge 2*a*, which in the present case is the folding edge or fold of the printed products 2, is exposed or free while a trailing edge 2*b* of the printed products 2 is covered by the next following or trailing printed product 2.

Figure 2:
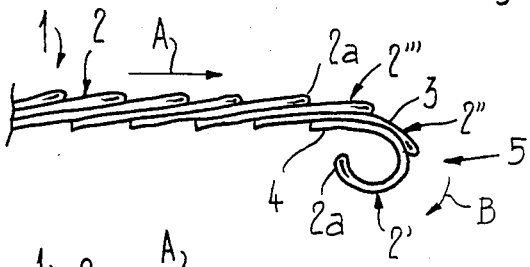
Figure 3:
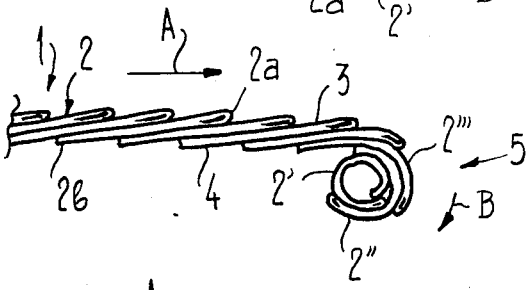

The imbricated formation 1 is conveyed in the direction of the arrow A towards a wind-up location, generally indicated by reference character 5. At the wind-up location 5 the imbricated formation 1 is wound-up starting with a leading end 1*a* thereof, in order to form a product roll. The wind-up operation may be accomplished with or without the use of a core although in many instances a core will be initially used for winding-up the imbricated formation 1. As shown in FIGS. 1 and 2, the winding operation is started in such a way that a leading and exposed or free edge 2*a* of a foremost or forwardmost printed product 2' is rolled-up in the direction towards the bottom side or surface 4 of this first and forwardmost located printed product 2'. As will be evident from FIG. 3, the further winding operation is effected in the same direction or sense. This winding direction is indicated in FIGS. 1 to 4 by the arrow B. Thus, the imbricated formation 1 is wound-up in such a manner that the leading edge 2*a* of each printed product 2 is rolled-back towards the bottom side or surface 4 thereof, and thus, away from the trailing printed products 2. Thus in FIG. 3 the printed product 2' is rolled back towards the bottom side 4 and away from the subsequent printed products 2'' and 2'''.

As will still be explained in greater detail hereinafter, the winding-up of the imbricated formation 1 in the direction B, as explained heretofore, is a precondition that the printed products 2 can be readily removed from a completed product package or product roll 7.

Towards the end of the wind-up or winding operation a band-shaped cover or strapping band element or holding element 6 is applied to a trailing end section 1*b* of the imbricated formation 1. This cover or strapping band element or holding element 6 is advantageously formed of a suitable material like, for example, kraft paper or plastic. The width of the holding element or strapping band element 6 approximately corresponds to the width of the printed products 2; however, the width thereof may also be smaller than the width of the printed products 2. The holding element or strapping band element 6 has a length which is greater by a certain amount than the circumferential length or circumference of the completed product roll 7 of printed products 2.

Figure 4:
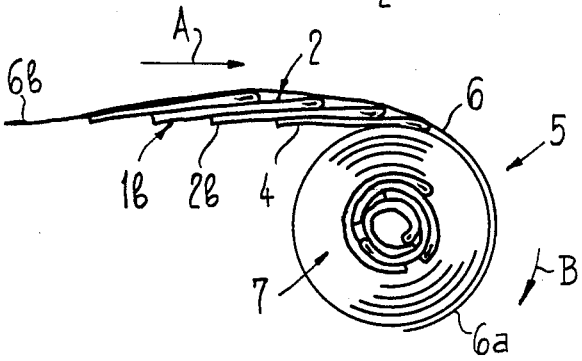
Figure 5:
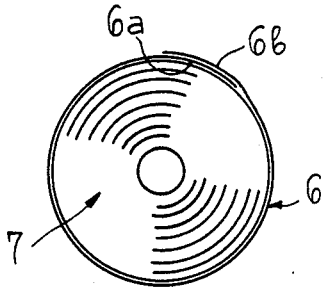
FIGS. 5 and 6 are respective schematic end views, shown in different scales, of a shipment product package of printed products produced according to the invention.

As will be evident from FIG. 4, the holding trailing end section 1*b* of the imbricated formation 1 in such a way that an end or end section 6*b* of the holding element or strapping band element 6 protrudes to the rear beyond the trailing end section 1*b* of the imbricated formation 1. The holding element or strapping band element 6 is wound-up conjointly with the trailing end section 1*b* of the imbricated formation 1, and during this operation the holding element or strapping band element 6 comes to rest on the outer side or surface of the product roll 7. As shown in FIG. 5 the trailing end 6*b* of the completely wound-up holding element or strapping band element 6 overlaps a front end 6*a* of such holding element or strapping band element 6. The two overlapping ends or end sections 6*a* and 6*b* are then interconnected in any suitable manner. For example, when one or both of the ends or end sections 6*a*, 6*b* are provided with a suitable self-adhesive prior to applying the holding element or strapping band element 6 to the imbricated formation 1, the two ends or end sections 6*a* and 6*b* can be interconnected during the course of the wind-up operation without requiring any significant additional expense. It will be self-evident that the connection between the two ends or end sections 6*a* and 6*b* of the holding element or strapping band element 6 can also be effected in a different manner as, for example, by welding or heat sealing in case that a plastic foil is used.

Figure 6:
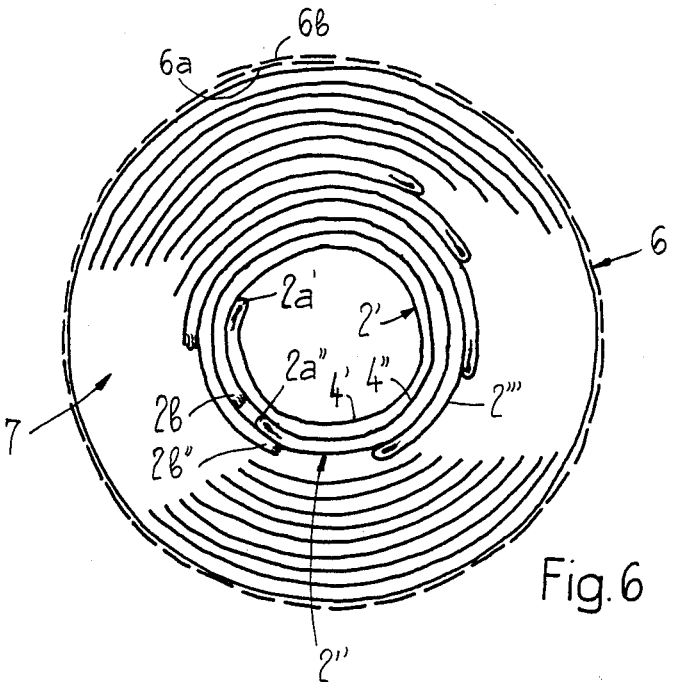

The holding element or strapping band element 6 also can be designed to have such a length and also can be applied to the trailing end section 1*b* of the imbricated formation 1 in such a manner that the holding element or strapping band element 6 is wound-up with its front end 6*a* between the last individual wound layers or plies of the wound-up printed products 2. FIGS. 5 and 6 show, in different scales, the roll-shaped product package or product roll 7 which is ready for shipment. As will be evident therefrom, the holding element or strapping band element 6 encircling the product roll 7 of printed products 2 not only serves to hold the product package or product roll 7 together, but also to protect the wound-up printed products 2. However, the holding element or strapping band element 6 may also be designed such as to perform only a protective function, an additional holding element or strapping banding element or ligature, for example, a plastic band or a cord being used to hold the product package or product roll 7 together. In case that no protection is required for the printed products 2, it will be sufficient to apply a holding element or strapping band or the like to the product package roll 7 to form a completed package.

Figure 7:
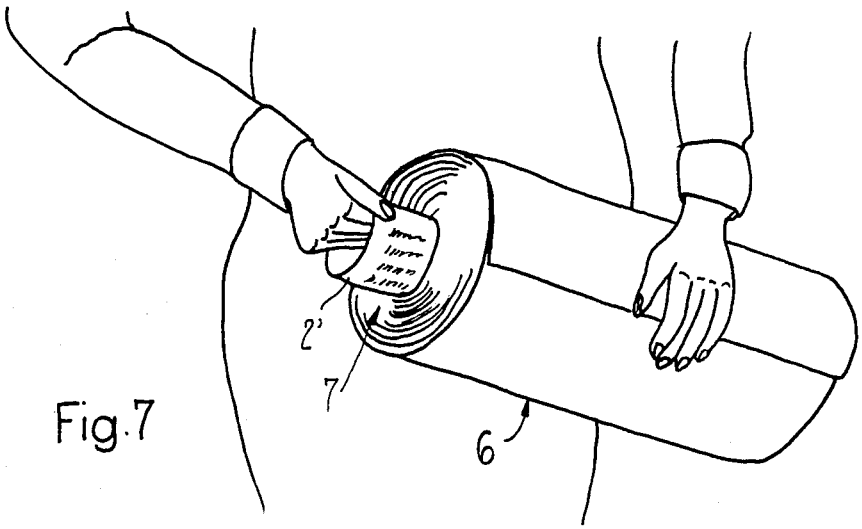
FIG. 7 is a perspective view illustrating the removal of an individual printed product from the roll-shaped product package shown in FIGS. 5 and 6.

In FIG. 6 the structure of the finished roll-like product package 7 will be recognized in greater detail and which finished product package is devoid of any core, i.e. is coreless. Due to the selected winding direction B, as explained with reference to FIGS. 1 to 4, the side or surface 4' of the innermost printed product 2' facing the center of the product package roll 7 does not contact any one of the following printed products 2'' or 2'''. The second printed product 2'' only engages the innermost printed product 2' at its inner side or surface 4'' facing the center of the product roll 7. This is similarly the case for the remaining printed products as illustrated by the printed product designated by the reference numeral 2'''. Such arrangement of the printed products 2 within the product package or product roll 7 now permits the roll-shaped package to be disassembled from the interior thereof. This means that the innermost printed product 2 may be withdrawn from the product roll 7 without entraining any further printed products 2 as will be evident from FIG. 7. It will be readily recognized from FIG. 6 that after removal of the innermost printed product 2' the next printed product 2'' in the series no longer contacts any other printed product with its inner side or surface 4'' facing the center of the product package or product roll 7. Consequently, also the second printed product 2'' can be withdrawn without any great effort from the product package or product roll 7 without entraining a further printed product. This is also true throughout for the remaining printed products.

Such a disassembly or build-off of the product package or product roll 7 from the interior thereof which, as explained, is effected without any great effort and without damage to individual printed products 2, renders superfluous the opening of the product package or product roll 7. This means that the holding element or strapping band element 6 may remain present until the end of the disassembling operation. The printed products 2 are thus still held together in their rolled-up shape even when individual specimens or copies have already been removed from the product package or product roll 7.

Although a primary objective of the invention is to form a coreless product package or product roll from which the printed products or the like can be removed from the center, the product roll produced according to the present invention affords still other advantages. For instance, for certain fields of application it might be easier or desirable to form such product rolls simply for shipping or transportation purposes instead of the conventional product stacks. The recipient or receiver of such product roll then simply opens the roll by removing the surrounding holding element or strapping band and thereafter forms a stack from the products which are now again present in an imbricated product formation.

It is also possible that the printed products 2 assume a mutual position within the imbricated product formation or imbricated product formation 1 which is different from the one shown in FIGS. 1 to 4. By suitably selecting the wind-up direction, however, it is also possible in such case to obtain a roll-shaped product package or product roll which corresponds in structure to the product package or product roll 7 shown in FIG. 6. In case that in the arriving imbricated formation 1 each printed product 2 rests with its bottom side or surface 4 on the top side or surface 3 of the following printed product 2, then the imbricated formation 1 would have to be wound-up in a direction which is opposite to the winding direction B as shown in FIGS. 1 to 4. Consequently, the leading edge 2*a* of the first printed product 2' would have to be rolled back upwardly towards the exposed top side or surface 3 of this first printed product 2'.

While there are shown and described present preferred embodiments of the invention, it is to be distinctly understood that the invention is not limited thereto, but may be otherwise variously embodied and practiced within the scope of the following claims. Accordingly,

What I claim is:

1. A coreless, self-contained ready-for-shipment package of printed products formed by winding-up an imbricated formation of printed products, said package comprising:

a product package roll defining a center and wound-up from said printed products;

said product package roll, when in a completely wound-up state, possesses a predetermined circumferential length and contains a multitude of printed products greater than two printed products;

a holding element extending around said product package roll and holding the same together;

said holding element having a length exceeding said circumferential length of said product package roll;

said holding element comprising two interconnected overlapping sections; and said printed products being individually removable from said center of said product package roll and without entraining a further printed product during such removal operation.

2. The package as defined in claim 1, wherein:

said holding element retains together the wound-up product package roll such as to form a self-supporting and self-contained ready-for-shipment package of printed products.

3. A method of preparing a coreless, self-contained ready-for-shipment package of printed products arriving in an imbricated product formation, comprising the steps of:

winding-up said imbricated formation containing a multitude of printed products containing more than two printed products from a first leading end thereof to form a product roll having a center;

said winding-up operation being started by rolling-up an exposed edge of the printed product located at said first leading end of said imbricated product formation in a direction towards one side of said printed product;

continuing said winding-up operation in the same direction and thereby forming said product roll of printed products by winding-up said imbricated product formation for subsequently removing printed products from said center of said product roll individually and without entraining a further printed product during such removal operation;

bringing together with an end section of said imbricated product formation at a second, trailing end thereof an elongated holding element so as to extend beyond said end section; and winding up said holding element conjointly with said imbricated product formation, thereby wrapping said holding element at least substantially one complete revolution around said product roll to hold the same together.

4. The method as defined in claim 3, further including the steps of:

connecting an end section of said elongated holding element which protrudes past said second trailing end of said imbricated product formation with another section of said elongated holding element.

5. The method as defined in claim 3, further including the steps of:

connecting a second end section of said holding element which protrudes past said second trailing end of said imbricated product formation with a first end section of said holding element.

6. The method as defined in claim 3, further including the steps of:

selecting a length of said holding element so as to be greater than the circumferential length of said product roll when completely wound-up; and interconnecting overlapping sections of said holding element.

7. The method as defined in claim 3, further including the steps of:

conveying said imbricated product formation in a predetermined direction of movement so as to define said first, leading end thereof; and starting said wind-up operation at said first, leading end.

8. The coreless package produced according to the method as defined in claim 3.

9. The method as defined in claim 3, wherein:

the holding element is wound-up conjointly with the imbricated product formation such that the product roll which is held together by the holding element forms a self-supporting and self-contained ready-for-shipment package of printed products.

* * * * *